United States Patent [19]

Goul

[11] Patent Number: 4,874,155

[45] Date of Patent: Oct. 17, 1989

[54] FAST CLAMP

[76] Inventor: Ashley S. Goul, P.O. Box 1869, Boise, Id. 83701

[21] Appl. No.: 242,633

[22] Filed: Sep. 9, 1988

[51] Int. Cl.[4] ..... B66F 3/00

[52] U.S. Cl. ..... 269/6

[58] Field of Search ..... 269/3, 6, 249, 216, 269/221, 228, 258, 143; 81/129, 152; 222/325-327, 391

[56] References Cited

U.S. PATENT DOCUMENTS

| | | | |
|---|---|---|---|
| 2,236,913 | 4/1941 | Merril | 269/249 |
| 3,151,897 | 10/1964 | Wagner | 269/258 |
| 4,185,811 | 1/1980 | Long | 269/6 |
| 4,220,322 | 9/1980 | Hobday | 269/6 |
| 4,378,937 | 4/1983 | Dearman | 269/228 |

*Primary Examiner*—Robert C. Watson

*Attorney, Agent, or Firm*—Klarquist, Sparkman, Campbell, Leigh & Whinston

[57] ABSTRACT

An improved c-clamp providing for faster operation and the integration of fewer moving parts into the clamp body and consisting of a smooth surfaced plunger, an advanced design in the clamp body, instrumentation for working the clamp using only one hand, and a more versatile contact head on the plunger.

5 Claims, 3 Drawing Sheets

FAST CLAMP

BACKGROUND OF THE INVENTION

1. Field of the Invention

The invention relates generally to hand tools and more specifically to clamping tools.

2. Description of Prior Art

C-clamps, used as a portable vise, for temporarily joining work pieces have been around for centuries, but in all that time the tool has progressed very little from its original design, structure and function. Primarily because its plunger is threaded, the conventional c-clamp is slow and awkward to use. Normal operation requires the work pieces to be staged, the clamp to be adjusted to approximate clamping distance, the work pieces to be staged for the final time, and the clamp then secured on the material, often with the help of a third hand from a friend. This process can be quite difficult when work pieces are heavy and tedious repetitive handling can be very strenuous.

Recently, an improved, alternative c-clamp has evolved, which makes this "friend" obsolete by providing a one handed advancing mechanism for the threaded plunger. Unfortunately, this one handed model appears to create more problems than it solves. First, like its ancestor, the one handed model uses a threaded plunge that advances slowly, requiring the work pieces to be staged, the clamp to be set at the approximate distance, the material to be staged again and the clamp then secured on the work pieces—this can be a distinct disadvantage when clamping heavier work pieces that must be held in place until the clamp is secured.

Second, the mechanism advancing the plunger extends beyond the clamp structure, becoming a potential obstacle that interferes with the staging and securing of the work pieces.

Third, because its driving mechanism is complicated in design and relies on many parts to advance the plunger, the existing one-handed c-clamp is expensive to manufacture.

Existing prior patents which may be pertinent to this invention are as follows:

| | | |
|---|---|---|
| R. L. Irelan | 4,436,294 | Mar. 13, 1984 |
| P. J. Y. Chang | 4,081,112 | Mar. 28, 1978 |
| J. Y. Wang | 4,582,307 | Apr. 15, 1984 |

Though it teaches a device incorporated in the c-clamp structure to facilitate the rapid advancement and retraction of the threaded plunger, the Wang patent still requires two hands for operation, thus requiring repeated handling of the work pieces and the clamp itself. The Irelan patent is the only one listed showing a one-handed design used in combination with a c-clamp type structure, but, as explained above, the threaded plunger slows operation and the complicated advancing mechanism protrudes outside the clamp body. Chang discloses a similar advancing mechanism, but here again, there is no economy in the space needed outside the body of the tool. No prior invention combines the advantages provided by a plunger that has a smooth surface and a threaded shaft.

SUMMARY OF THE INVENTION

The inventive concept set forth in this invention is to use a smooth surfaced plunger, allowing for significantly faster and easier clamp use; the integration of the advancing, locking, recoil and release mechanisms entirely within the c-clamp framework. The smooth surfaced plunger requires fewer moving parts, preserving the simple and efficient nature of the c-clamp.

The principle advantage achieved is faster operation through the entire clamping cycle—i.e., plunger opened to capacity, advanced to secure work pieces and returned to the fully open position—making repetitive fast clamping possible with only one hand. This speed in operation is especially helpful when the work pieces are heavy or awkward to hold in place. The clamp can be opened to capacity using only one hand, the work pieces can be positioned with the other hand and regardless of width, can be secured by the clamp in a few strokes of the trigger.

The clamp is more versatile, in terms of the locations that can be accessed to complete the clamping operation and shapes of the work pieces to be clamped, as a result of the entire operating assembly being contained within the clamp body.

Moreover, fewer moving parts and design simplicity significantly reduce manufacturing costs.

Another object of the invention is to create the opportunity to adjust the pressure on the work pieces and/or temporarily making the contact head rigid inside the ball and socket joint.

DESCRIPTION OF PREFERRED EMBODIMENTS

Figure 1:
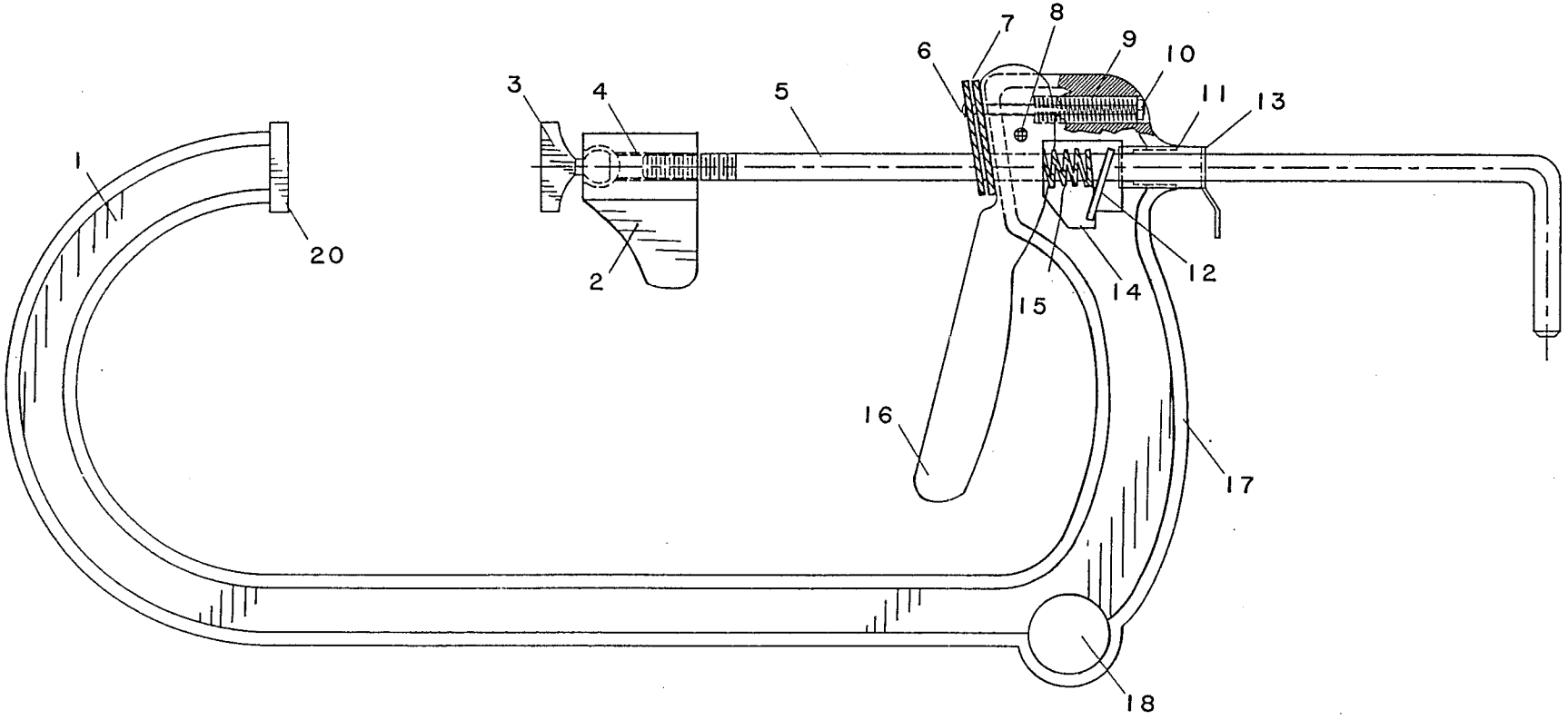
FIG. 1 is a side view of the main C-shaped structure showing the plunger operating instrumentation, the characteristics of the unique shapes involved in the body structure.

FIG. 1 shows the C-shaped clamp body 1 which includes a pistol-grip shaped handle 17 at the posterior of the body, a finger hole 18 at the bottom of this handle, a lateral opening from which to anchor to the grip and pivot 8 the trigger 16, an opening running front to back that forms the plunger sleeve 11, a second opening running front to back housing the recoil pin 6, the recoil spring 9 and the washer and nut 10 of the recoil assembly and an irregular shaped seven sided lateral opening 14 housing the locking key 12, and the locking key spring 15.

As illustrated in FIG. 1 the plunger 5 passes first through the plunger sleeve 11 then through the locking key 12 and the locking key spring 15 through the second portion of the plunger sleeve 11 and through the two advancing keys 7 in a direction that will bring the pressure nut 2 into contact with the stationary contact point 20 at the front of the clamp body 1.

The two advancing keys 7 are rectangular in shape with two holes in each—one near the bottom, through which the plunger 5 passes, and one near the top, through which the recoil pin 6 passes. The hole through which the plunger passes is large enough in diameter to allow free forward and backward movement of the plunger when the advancing keys 7 rest at a nearly perpendicular attitude, but are close enough in size to the actual diameter of the plunger that they will wedge on the plunger when forced off the perpendicular attitude.

The trigger 16 is a three-sided structure that envelopes the grip 17 and is anchored in only one place by a rivet 8 passing laterally through the head of the grip.

Figure 2:
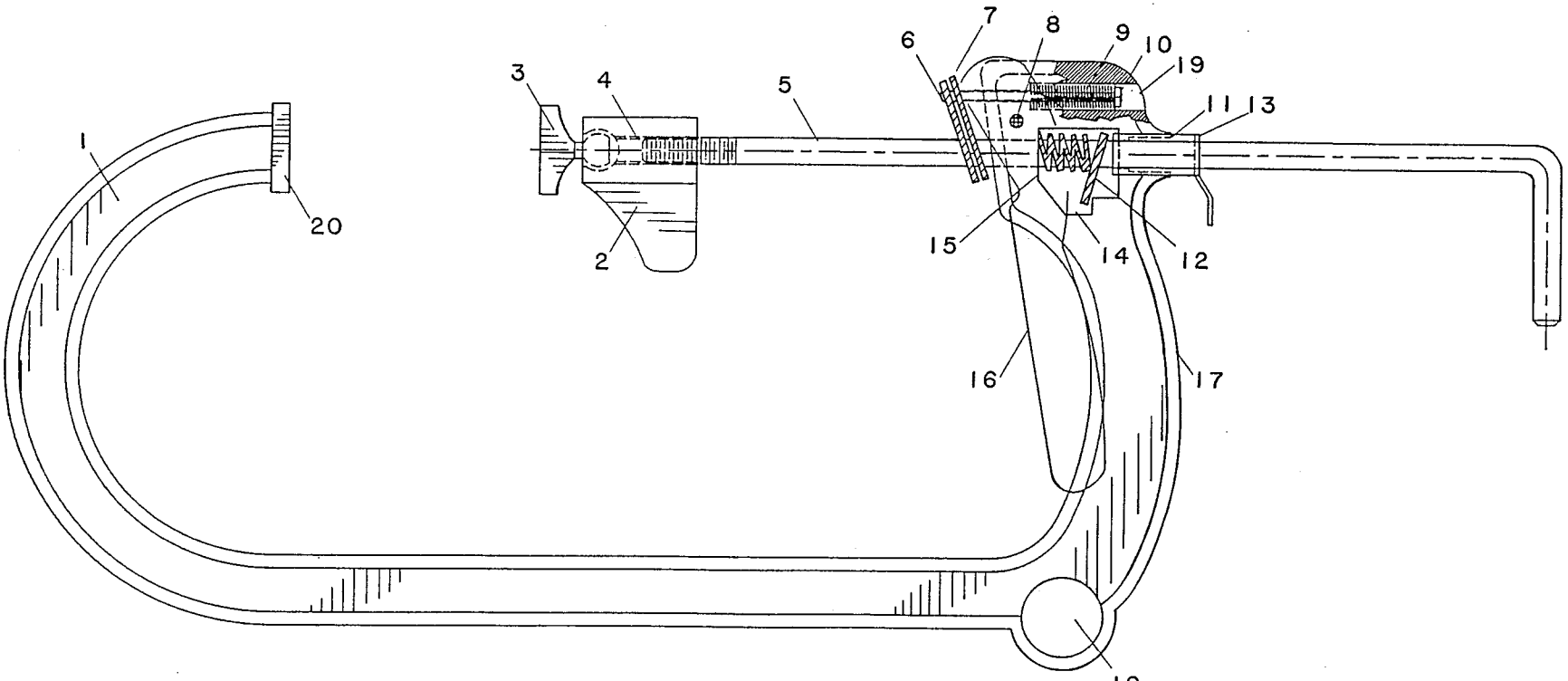
FIG. 2 is a side view similar to that of FIG. 1, but with the trigger in the compressed position.

It is apparent in examining FIG. 2 that as the trigger is squeezed it pivots toward the grip on the bottom and away from the grip at the top. This movement, at the top, away from the head of the grip, causes the trigger to engage the advancing keys 7 and force the top of the keys forward, this forward movement of the keys results in the keys being wedged on the plunger 5 so that the balance of the trigger's pivoting motion pushes both the keys and the plunger forward.

The recoil pin runs from front to back, first through the upper hole in the advancing keys 7 where it is held in place by a rounded head, and then through the trigger 16, through the smaller portion of the recoil assembly housing 19 and into the larger portion of the housing in a length that when is fully recoiled does not protrude from the clamp body. In FIG. 2 the recoil spring 9 is compressed and held in contact with the recoil pin by the washer and nut 10. Releasing pressure on the trigger allows the spring to uncoil and force the recoil pin toward the back of the clamp pulling with it the advancing keys 7, which slide back over the plunger in a nearly perpendicular attitude from the pressure applied at the top of the keys by the recoil pin, and returning the trigger 16 to the beginning of the advancing mechanism cycle. All parts of the advancing mechanism will return to their original position, leaving the plunger at the advanced position, ready to begin another advancing cycle.

Figure 3:
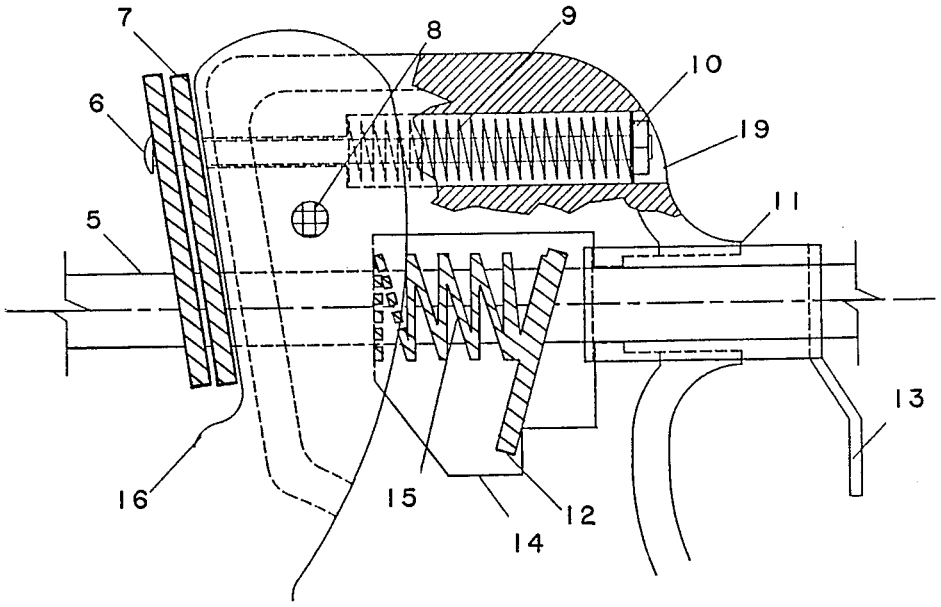
FIG. 3 is an enlarged side view of the plunger operating instrumentation.

FIG. 3 shows in larger detail the locking key 12, the locking key spring 15 and the opening forming the locking key housing 14. At its anterior, end the spring rests on the front side of the opening 14 which is perpendicular to and surrounds the plunger. The posterior end of the spring contacts the locking key which pivots off a protrusion near the bottom of the opening 14 and wedges against the plunger The plunger can still slide forward but not backward.

Also seen in FIG. 3 in larger detail is the locking key release, 13 a three sided structure enveloping the posterior section of the plunger sleeve with a hole in the two parallel sides through which the plunger passes. The posterior of the two parallel sides extends downward. Pressure on the extended portion of the locking key release will advance the structure forward along the plunger 5. The anterior side of the structure will contact the locking key 12 and cause the locking key to move more toward a right angle with the plunger 5 thus releasing the plunger to move freely forward or backwards.

Figure 4:
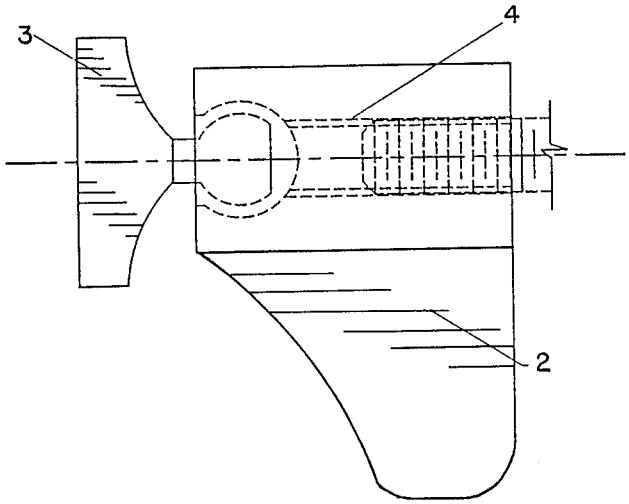
FIG. 4 is an enlarged side view of the pressure nut assembly.

FIG. 4 shows the pressure nut assembly that is attached to the front threaded portion of the plunger and consists of a tubular shaped body with a protruding flange 2, a threaded opening, 4 and a ball and socket joint at the front supporting the contact head 3. Rotating the assembly clockwise will advance the contact head forward on the threads of the plunger. Once the work pieces have been secured between the stationary contact point 20 and the contact head 3, this operation may be used to apply additional pressure to those work pieces. Rotating the assembly counter-clockwise will move the assembly backward toward the grip of the clamp once the tip of the plunger makes contact with the ball of the ball and socket joint, it will press the ball forward in the socket joint and wedge it there, making the contact head rigid.

I claim:

1. A clamping apparatus for clamping a workpiece, comprising:

a clamp body, the body having a first end with a contact point and an opposing handle end defining a sleeve aligned with the contact point;

a plunger sized to slide within the sleeve toward and away from the contact point;

advancing means for moving the plunger toward the contact point, the advancing means having a first end defining an opening through which the plunger extends and a second end spaced apart from the plunger;

trigger means pivotally mounted to the handle end for pressing the second end of the advancing means toward the contact point when the trigger means is squeezed, the advancing means when so pressed wedging against the plunger to move the plunger toward the contact point;

retracting means for urging the second end of the advancing means toward the handle end when the trigger means is released, the advancing means when so moved sliding freely relative to the plunger ;

locking means for maintaining the plunger in place after it has been moved by the action of the trigger means and advancing means, the locking means having a first end defining an opening through which the plunger extends, a second end spaced apart from the plunger, and a bias means urging the second end away from a position perpendicular to the plunger to allow movement of the plunger toward the contact point but to prevent movement of the plunger away from the contact point; and release means for urging the second end of the locking means toward a position perpendicular to the plunger to allow for movement of the plunger away from the contact point.

2. The apparatus of claim 1 including a contact head threadedly connected to one end of the plunger, the head including a tightening flange for advancing the contact head relative to the plunger toward the contact point to tighten the head against a workpiece clamped between the plunger and the contact point.

3. The apparatus of claim 1 wherein the retracting means comprises pin means slidably mounted within the handle end of the clamp body and connected to the second end of the advancing means, the pin means biased to urge the advancing means into contact with the handle end.

4. The apparatus of claim 1 wherein the bias means within the locking means comprises a spring mounted on the plunger, and the release means is slidably mounted on the plunger to be pressed against a side of the second end of the locking means opposite the spring to counteract its bias.

5. A clamping apparatus for clamping a workpiece, comprising:

a C-shaped clamp body, the body having a first end of the body with a contact point and an opposing handle end defining a sleeve in the body aligned with the contact point;

a plunger sized to slide within the sleeve toward and away from the contact point;

a contact head threadedly connected to one end of the plunger, the head including a tightening flange for advancing the contact head relative to the plunger toward the contact point to tighten the head against a workpiece clamped between the plunger and the contact point;

ad advancing key for moving the plunger toward the contact point, each key having a first end defining an opening through which the plunger extends and a second end spaced apart from the plunger;

a trigger pivotally mounted to the handle end for pressing the second end of the advancing key toward the contact point when the trigger is squeezed, the advancing key when so pressed wedging its first end against the plunger to move the plunger toward the contact point;

a recoil pin slidably mounted within a second sleeve in the handle end of the clamp body and connected to the second end of the advancing key, the recoil pin biased to urge the advancing key toward the handle end when the trigger is released, the advancing key when so moved sliding freely relative to the plunger ;

a locking key for maintaining the plunger in place after it has been moved by the action of the trigger and advancing key, the locking key having a first end defining an opening through which the plunger extends, a second end spaced apart from the plunger, and a spring mounted to the plunger for urging the second end away from a position perpendicular to the plunger to allow movement of the plunger toward the contact point but to prevent movement of the plunger away from the contact point; and a release slidably mounted to the plunger to be pressed against a side of the second end of the locking key opposite the spring to counteract its bias and urge the second end of the locking key toward a position perpendicular to the plunger to allow for movement of the plunger away from the contact point.

* * * * *

UNITED STATES PATENT AND TRADEMARK OFFICE

CERTIFICATE OF CORRECTION

PATENT NO. : 4,874,155

DATED : October 17, 1989

INVENTOR(S) : Ashley S. Goul

It is certified that error appears in the above-identified patent and that said Letters Patent is hereby corrected as shown below:

ON TITLE PAGE:

Section [56], References Cited should include:

| | | |
|---|---|---|
| 419,379 | 1/1890 | Talbot |
| 1,187,109 | 6/1916 | Steuernagel |
| 1,716,887 | 6/1929 | Griesell |
| 2,009,044 | 7/1935 | Davis |
| 3,448,957 | 6/1969 | Friedman |
| 4,081,112 | 3/1978 | Chang |
| 4,436,294 | 3/1984 | Irelan |
| 4,582,307 | 4/1986 | Wang |
| D 143,096 | 12/1945 | Sasgen |

Column 1, line 51, "April 15, 1984" should be --April 15, 1986--.

Column 5, line 11, "ad" should be --an--.

Signed and Sealed this

Thirteenth Day of August, 1991

*Attest:*

*Attesting Officer*

HARRY F. MANBECK, JR.

*Commissioner of Patents and Trademarks*